US007871243B2

(12) United States Patent
Chen et al.

(10) Patent No.: US 7,871,243 B2
(45) Date of Patent: Jan. 18, 2011

(54) AUGMENTED VANELESS DIFFUSER CONTAINMENT

(75) Inventors: Robert P. Chen, Torrance, CA (US); Terry Morris, Garden Grove, CA (US); Deborah A. Osborne, Redondo Beach, CA (US)

(73) Assignee: Honeywell International Inc., Morristown, NJ (US)

( * ) Notice: Subject to any disclaimer, the term of this patent is extended or adjusted under 35 U.S.C. 154(b) by 1076 days.

(21) Appl. No.: 11/758,131

(22) Filed: Jun. 5, 2007

(65) Prior Publication Data

US 2008/0304953 A1 Dec. 11, 2008

(51) Int. Cl.
*F01B 25/16* (2006.01)

(52) U.S. Cl. ..... 415/149.1; 415/208.2; 415/211.2; 415/224.5

(58) Field of Classification Search ..... 415/1, 415/126, 146, 149.1, 208.1, 208.2, 211.1, 415/211.2, 224.5
See application file for complete search history.

(56) References Cited

U.S. PATENT DOCUMENTS

| | | | | |
|---|---|---|---|---|
| 3,105,632 | A * | 10/1963 | Tanzberger | 417/323 |
| 3,478,955 | A * | 11/1969 | Kunderman | 417/507 |
| 4,579,509 | A * | 4/1986 | Jacobi | 415/199.1 |
| 4,778,334 | A * | 10/1988 | Medgyesy et al. | 415/199.1 |
| 5,064,344 | A * | 11/1991 | Kassel et al. | 415/224.5 |
| 6,224,321 | B1 | 5/2001 | Ebden et al. | |
| 6,695,574 | B1 | 2/2004 | Mather | |
| 6,872,050 | B2 * | 3/2005 | Nenstiel | 415/151 |
| 2005/0232762 | A1 | 10/2005 | Smoke et al. | |
| 2007/0036646 | A1 | 2/2007 | Nguyen et al. | |
| 2007/0110566 | A1 | 5/2007 | Montgomery et al. | |

FOREIGN PATENT DOCUMENTS

| | | | |
|---|---|---|---|
| DE | 4438611 | A1 | 5/1996 |
| DE | 102005025857 | A1 | 12/2006 |
| EP | 799368 | A1 | 10/1997 |
| JP | 2005291004 | A | 10/2005 |
| WO | 0109488 | A1 | 2/2001 |
| WO | 02090722 | A1 | 11/2002 |

OTHER PUBLICATIONS

European Search Report dated May 4, 2010.

* cited by examiner

*Primary Examiner*—Igor Kershteyn
(74) *Attorney, Agent, or Firm*—Oral Caglar, Esq.

(57) ABSTRACT

A containment system comprises at least one passage obstructer extending from a housing inlet cover through a diffuser passage and into a housing back cover. The passage obstructer includes a fastener portion, such as a bolt, and an obstructing portion extending from and integral to a shaft of the fastener portion. The diameter of the obstructing portion is less than the diameter of the shaft, allowing the obstructing portion to bend upon impact with a burst impeller fragment.

14 Claims, 9 Drawing Sheets

AUGMENTED VANELESS DIFFUSER CONTAINMENT

BACKGROUND OF THE INVENTION

The present invention generally relates to systems for containing a burst impeller or impeller fragments and, more particularly, to containment systems that include a vaneless diffuser.

A prior art compressor 30, as depicted in FIG. 1, can include one or more impellers 31 in contact with a rotating shaft 32. A housing structure 35, which may comprise one or more members fastened together by housing fasteners 36, can enclose the impeller 31. The housing structure 35 can include a radially outer wall 33, as depicted in FIGS. 1 and 2. In some circumstances, due to, for example, corrosion, defect or fatigue, the impeller 31 can fracture and burst from the shaft 32 during operation. In the event of an impeller fracture, the impeller 31 may break into two, three or more large fragments that are thrown radially outward from the shaft 32, through a diffuser 37 and toward the radially outer wall 33 due to centrifugal force. Fragments of the impeller 31 can penetrate the thin-walled portions of the radially outer wall 33. The burst impeller fragments can form a hole 34 through the radially outer wall 33, as depicted in FIG. 3. The hole 34 may allow the impeller fragments to escape from the housing 35. To minimize or prevent damage to the aircraft, systems for containing the burst impeller fragments have been described in the prior art.

U.S. Pat. No. 6,695,574 discloses an energy absorber and deflection device for deflecting engine debris fragments from a core of a gas turbine engine. The device includes a deflection plate radially spaced from and adapted to cover any rotating component of the engine. The disclosed device may be used to contain fan blade fragments, rotor fragments, broken shaft fragments, compressor fragments, turbine blade fragments or turbine rotor fragments. Unfortunately, the deflection plate adds weight to and increases the envelope of the engine. Although the described device may be used to contain engine debris, it is not suitable for some applications due to envelope and weight restrictions.

U.S. Pat. No. 6,224,321 discloses an impeller containment system. The described system utilizes a catcher extending from a shroud plate adjacent to the impeller, which engages with a snubber formed as a unitary part of the impeller. The catcher and snubber cooperate to restrain a burst impeller or impeller fragments to their shortest radial distance from their point of burst. The described system also includes a shroud, which circumferentially surrounds the impeller and a diffuser, which circumferentially surrounds the radial tip portions of the impeller. The back plate of the described containment system has a catcher groove and flange and the impeller has a snubber groove and flange. These grooves and flanges increase the complexity of the compressor components. The described system adds further complexity by including a bayonet flange on the impeller shroud that is designed to interact with a recessed grooved portion of the diffuser.

Other fragment containment methods have included increasing the strength of the shroud by increasing the thickness of the housing walls. Unfortunately, increasing wall thickness increases system weight.

For some compressors, the inclusion of vaned diffusers can provide sufficient fragment containment. Unfortunately, vaned diffusers are not suitable for all compressor designs.

As can be seen, there is a need for improved containment systems. Additionally, containment systems are needed that do not adversely affect the weight and envelope of the engine/machine. Further, simple containment systems are needed that do not require complex component designs. Moreover, containment systems are needed for compressor designs that do not include vaned diffusers.

SUMMARY OF THE INVENTION

In one aspect of the present invention, a system for an impeller comprises a housing surrounding the impeller; a diffuser passage defined by the housing; and at least one passage obstructer having an obstructing portion, the obstructing portion extending through the diffuser passage.

In another aspect of the present invention, an apparatus for a compressor having a vaneless diffuser comprises a fastener portion; and an obstructing portion integral to the fastener portion, the obstructing portion extending axially through the vaneless diffuser.

In a further aspect of the present invention, a method of containing a burst impeller fragment comprises the steps of obstructing a path of the burst impeller fragment with at least one passage obstructer; and adsorbing at least a portion of the energy of the burst impeller fragment.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides containment systems and methods for containing burst impellers. Embodiments of the present invention may find beneficial use in many industries including aerospace, automotive and electricity generation. Embodiments of the present invention may be beneficial in applications including manufacturing and repair of aerospace components. Embodiments of the present invention may be useful in all radial debris containment application, such as but not limited to, burst impeller containment for aircraft engines.

In one embodiment, the present invention can incorporate modified fasteners (passage obstructers) at some of their existing locations to enhance the in-situ containment capacity during a tri-hub burst test. The passage obstructers can replace the existing housing fasteners used in the first stage vacuum generator compressor inlet cover/middle housing to tie in with the second stage vacuum generator compressor back housing. The passage obstructers of the present invention can be positioned such that they extend axially through the diffuser of the compressor to obstruct the path of the burst impeller fragments. Unlike the prior art that includes a deflection plate radially spaced from the compressor, the present invention does not adversely affect the weight or the envelope of the machine. Unlike the prior art that includes complex snubbers and catchers, the present invention can include simple modified fasteners that comprise extended studs. Unlike the prior art designs that require vaned diffusers for fragment containment, the present invention can be used with compressor designs having vaneless diffusers.

Figure 1:
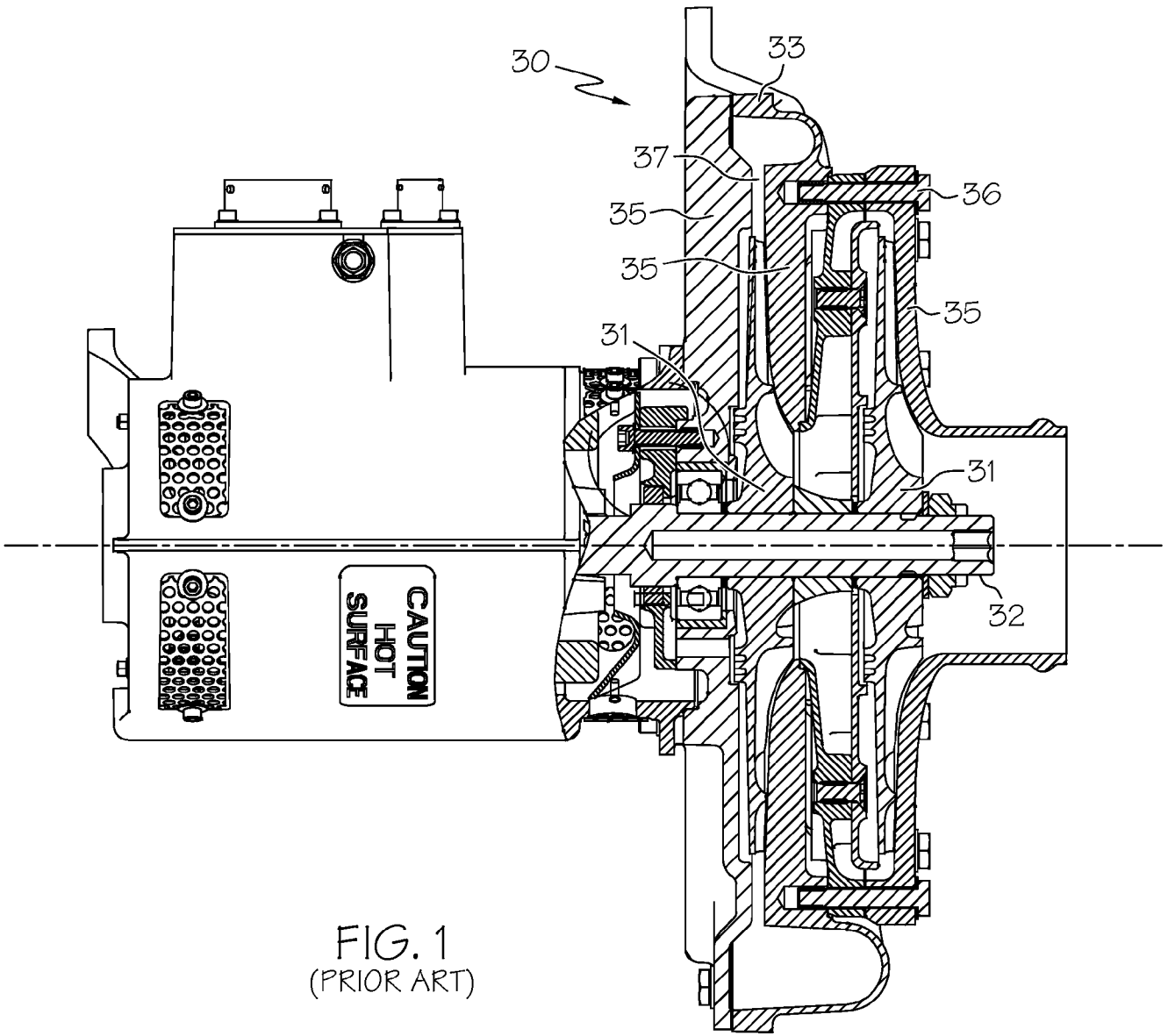
FIG. 1 (PRIOR ART)
FIG. 1 is a cross-sectional view of a prior art compressor.
Figure 2:
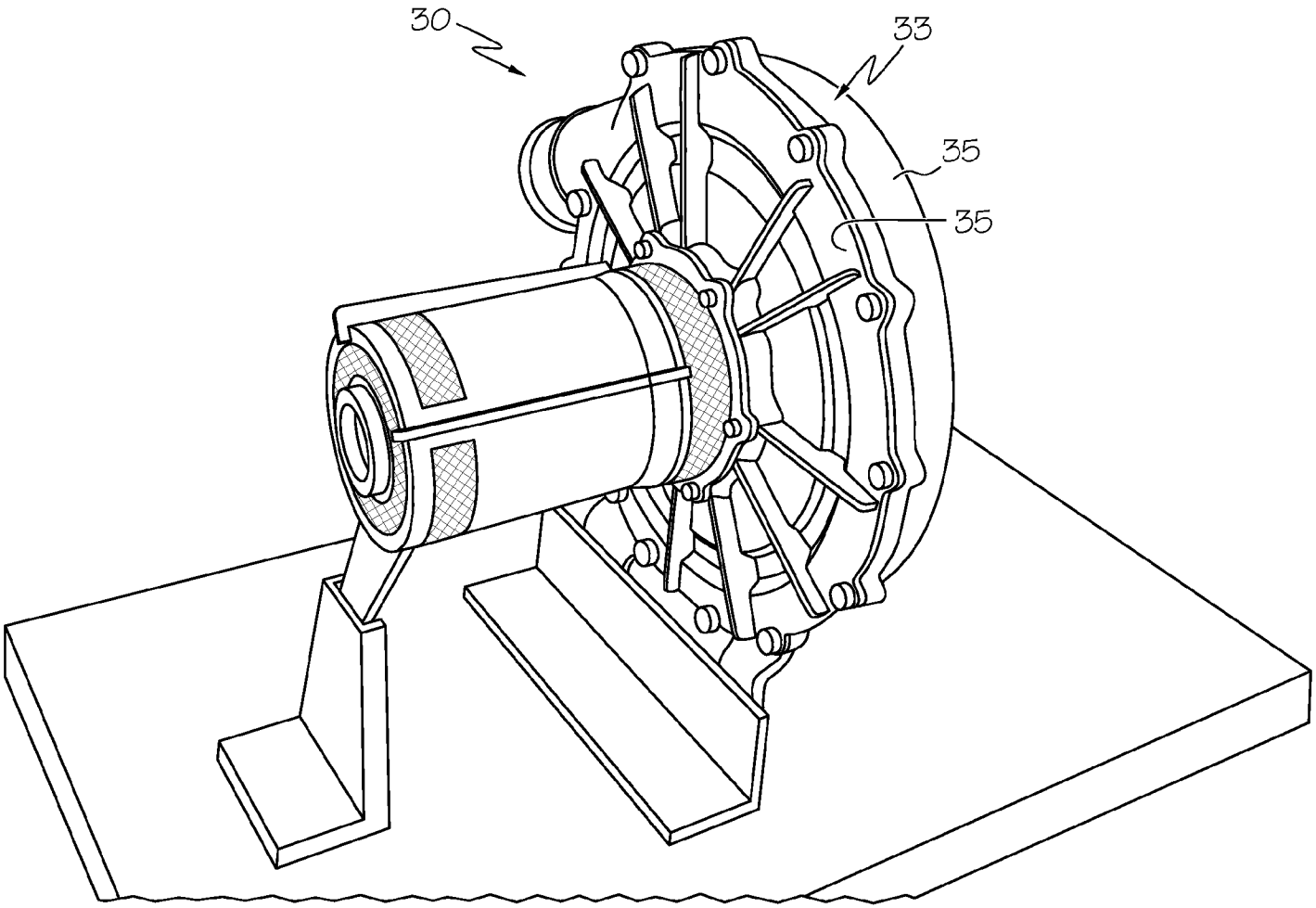
FIG. 2 (PRIOR ART)
FIG. 2 is a perspective view of the prior art compressor of FIG. 1.
Figure 3:
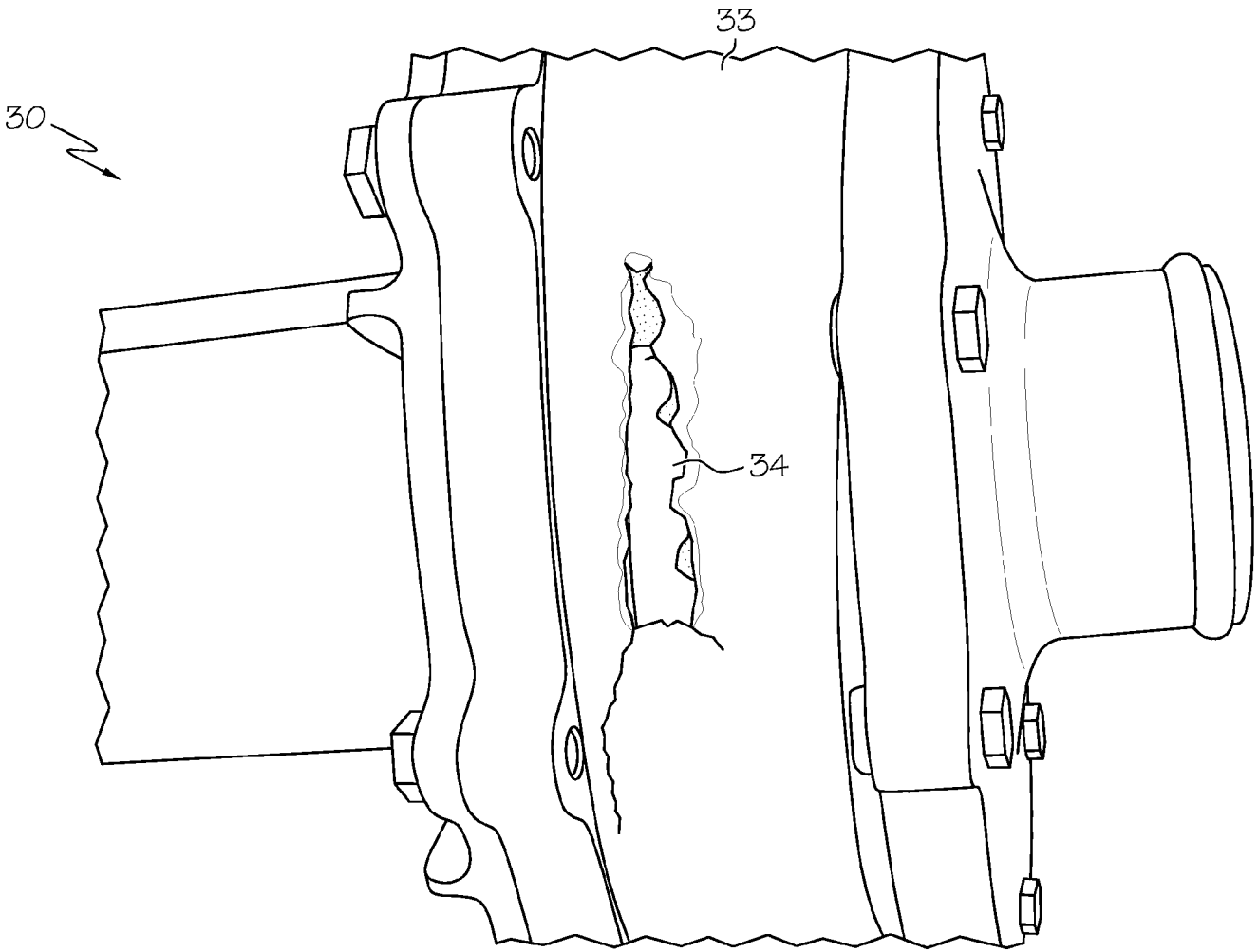
FIG. 3 (PRIOR ART)
FIG. 3 is a perspective view of a hole through a scroll housing of a prior art compressor.
Figure 4:
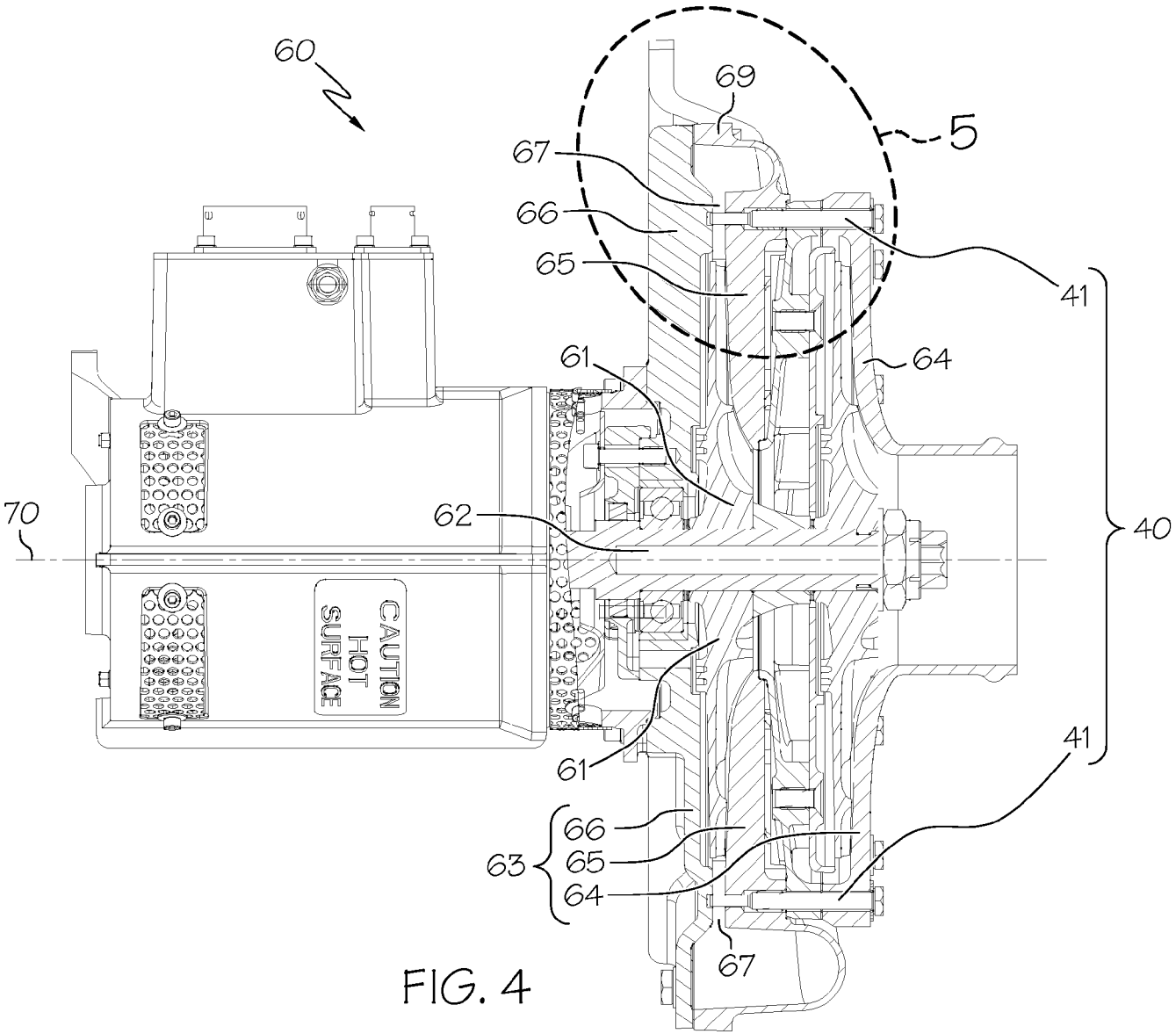
FIG. 4 is a cross-sectional view of a containment system installed on a compressor, according to an embodiment of the present invention.

A containment system 40 installed in a compressor 60, according to an embodiment of the present invention is depicted in FIG. 4. The containment system 40 may comprise at least one, but preferably three or more, passage obstructers 41 positioned radially outward from an impeller 61 and radially inward from a scroll housing containment structure 69. The impeller may be operationally connected to a shaft 62. A housing 63, which may include the scroll housing containment structure 69, may surround the impeller 61 and may define a diffuser passage 67. The passage obstructer 41 may be in contact with the housing 63 and may extend axially through the diffuser passage 67. Axial and radial may be defined with reference to a line 70 through the shaft 62 of the compressor 60.

Figure 5:
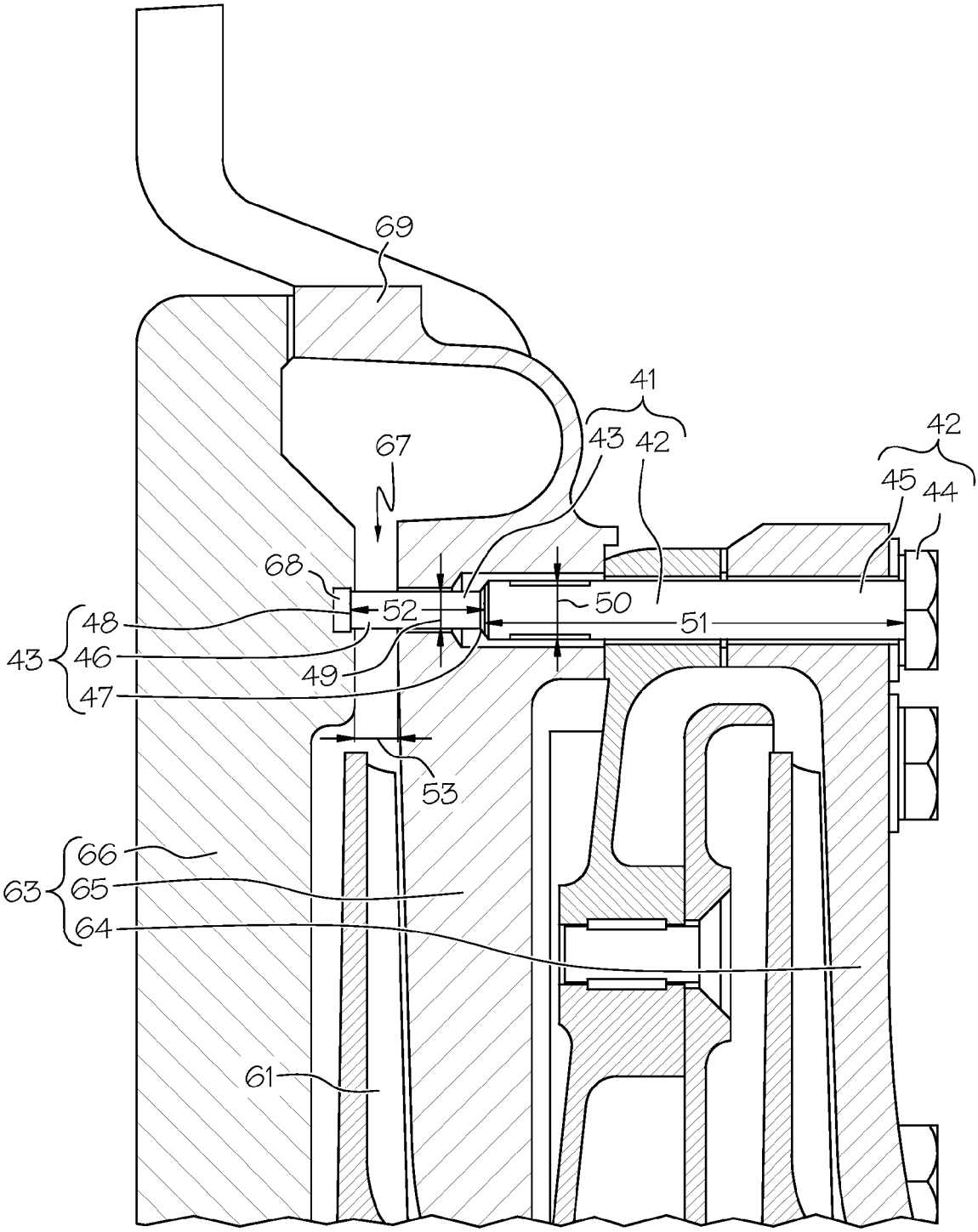
FIG. 5 is a close-up view of section 5 of FIG. 4.
Figure 6:
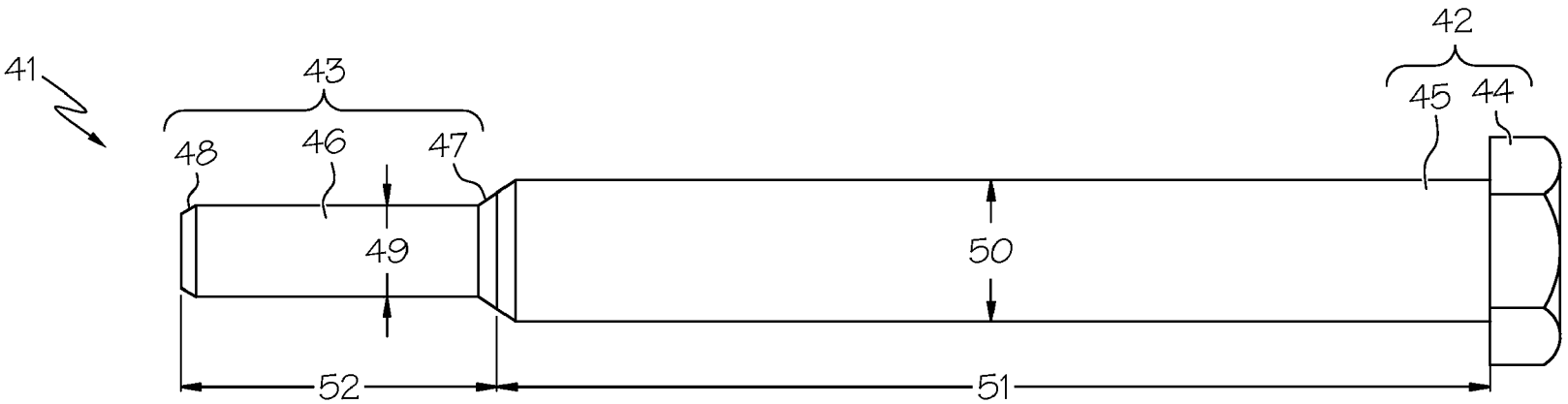
FIG. 6 is a close-up view of the passage obstructer of FIG. 5.

The passage obstructer 41, as depicted in FIGS. 5 and 6, may comprise a fastener portion 42 and an obstructing portion 43 integral to the fastener portion 42. The fastener portion 42 may be in contact with the housing 63. The obstructing portion 43 may extend axially through the diffuser passage 67. For embodiments including the fastener portion 42 and the obstructing portion 43, the passage obstructer 41 may be an extended stud shaped structure, as depicted in FIGS. 5 and 6. In some embodiments, not shown, the passage obstructer 41 may comprise the obstructing portion 43 and may not include the fastener portion 42. For these embodiments, the passage obstructer 41 may comprise a mechanical means of blocking the impeller 61, such as a pin shaped structure. The pin shaped structure may be pressed through the housing 63.

The fastener portion 42, as depicted in FIGS. 5 and 6, may comprise a conventional fastener, such as a bolt. The fastener portion 42 may comprise a fastener head 44 and a fastener shaft 45 extending from the fastener head 44. The fastener portion 42 may fasten two housing members together. The housing 63 may comprise more than one housing member, for example, the housing 63 may comprise a first stage inlet cover 64, a middle housing 65 and a back housing 66. For some two-stage compressor applications, the fastener portion 42 may fasten the first stage inlet cover 64 to the middle housing 65. The fastener head 44 may be in contact with the first stage inlet cover 64 and the fastener shaft 45 may extend through the first stage inlet cover 64 and through at least a portion of the middle housing 65. For two-stage compressor applications, the fastener portions 42 may replace existing fasteners used to fasten the first stage inlet cover 64 to the middle housing 65. For some single-stage compressor applications (not depicted), the fastener portion 42 may be in contact with and extend through the inlet cover 64.

The dimensions of the fastener shaft 45 may vary with application. The length of the fastener shaft 45 (fastener shaft length 51) may depend of the thickness of the housing 63 and on the number of housing members through which the fastener shaft 45 extends. For example, for some two-stage compressor applications the fastener shaft length 51 may be between about 1.0 and about 3.0 inches. For some single-stage compressor applications the fastener shaft length 51 may be between about 0.50 and about 1.00 inches. The diameter of the fastener shaft 45 (fastener shaft diameter 50) may vary with application and may depend on the closing force required for the housings and operating conditions. For example, for some two-stage compressor applications, the fastener shaft diameter 50 may be between about 0.060 and about 0.250 inches.

The obstructing portion 43, as depicted in FIGS. 5 and 6, may be integral to and extend axially from the fastener shaft 45. The obstructing portion 43 may comprise an elongated member 46 having a first end 47 and a second end 48. The first end 47 may be integral to the fastener shaft 45. The elongated member 46 may be cylindrical and may extend from the fastener shaft 45, through the diffuser passage 67 and into the back housing 66. The elongated member 46 may extend such that a portion of the elongated member 46 towards the second end 48 (penetrating portion) is positioned within a recess 68 of the back housing 66. The penetrating portion of the elongated member 46 may increase the end fixity of the obstructing portion 43 during impeller fragment impact.

The obstructing portion 43 may be designed such that the obstructing portion 43 may be bent by the impact of an impeller fragment. The obstructing portion 43 may obstruct the path of the fragment, reduce the velocity of the fragment or stop the outward movement of the fragment. The dimensions of the obstructing portion 43 may vary with application. The length of the obstructing portion 43 (obstructing portion length 52) may depend on the width of the diffuser passage 67 (diffuser passage width 53) and the depth of the recess 68 (recess depth). For some applications, the obstructing portion length 52 may be at least about equal to the sum of the width of the diffuser passage 67 plus the depth of the recess 68, as depicted in FIG. 5. For example, when the diffuser passage 67 has a width of about 0.40 inches and the recess 68 has a depth of about 0.08 inches, the length of the obstructing portion 43 may be about 0.48 inches. The diameter of the obstructing portion 43 (obstructing portion diameter 49) may vary with application and may depend of the strength requirements of the compressor 60. The obstructing portion diameter 49 may be less than the fastener shaft diameter 50. For example, when the fastener shaft diameter 50 is about 0.20 inch, the obstructing portion diameter 49 may be about 0.10 inch. The obstructing portion diameter 49 may be large enough that impeller fragments may be contained and small enough that compressor performance may not be degraded. For some aircraft applications, the obstructing portion diameter 49 may be at least about 1.00 inches. For some aircraft applications, the obstructing portion diameter 49 may be less than about 0.20 inches. For some compressor applications, the obstructing portion diameter 49 may be between about 0.050 and about 0.20 inches.

The depth of the recess 68 may be about equal to or greater than the length of the penetrating portion of the elongated member 46. The depth of the recess 68 may depend on the thickness of the back housing 66 and may be designed such that the recess 68 does not adversely affect the structural integrity of the back housing 66. For example, the depth of the recess 68 may be between about 0.050 and about 0.10 inches when the thickness of the back housing 66 is about 0.20 inches. The depth of the recess 68 may be deep enough to retain at least some of the obstructing portion 42. In other words, the recess may be deep enough to prevent the second end 48 of the obstructing portion 43 from easily sliding along the surface of the back housing 66 to prevent plastic bending deformation. For some aircraft applications, the depth of the recess 68 may be at least about 0.025 inches. The recess 68 may be formed by conventional machining techniques or casting methods.

Figure 7:
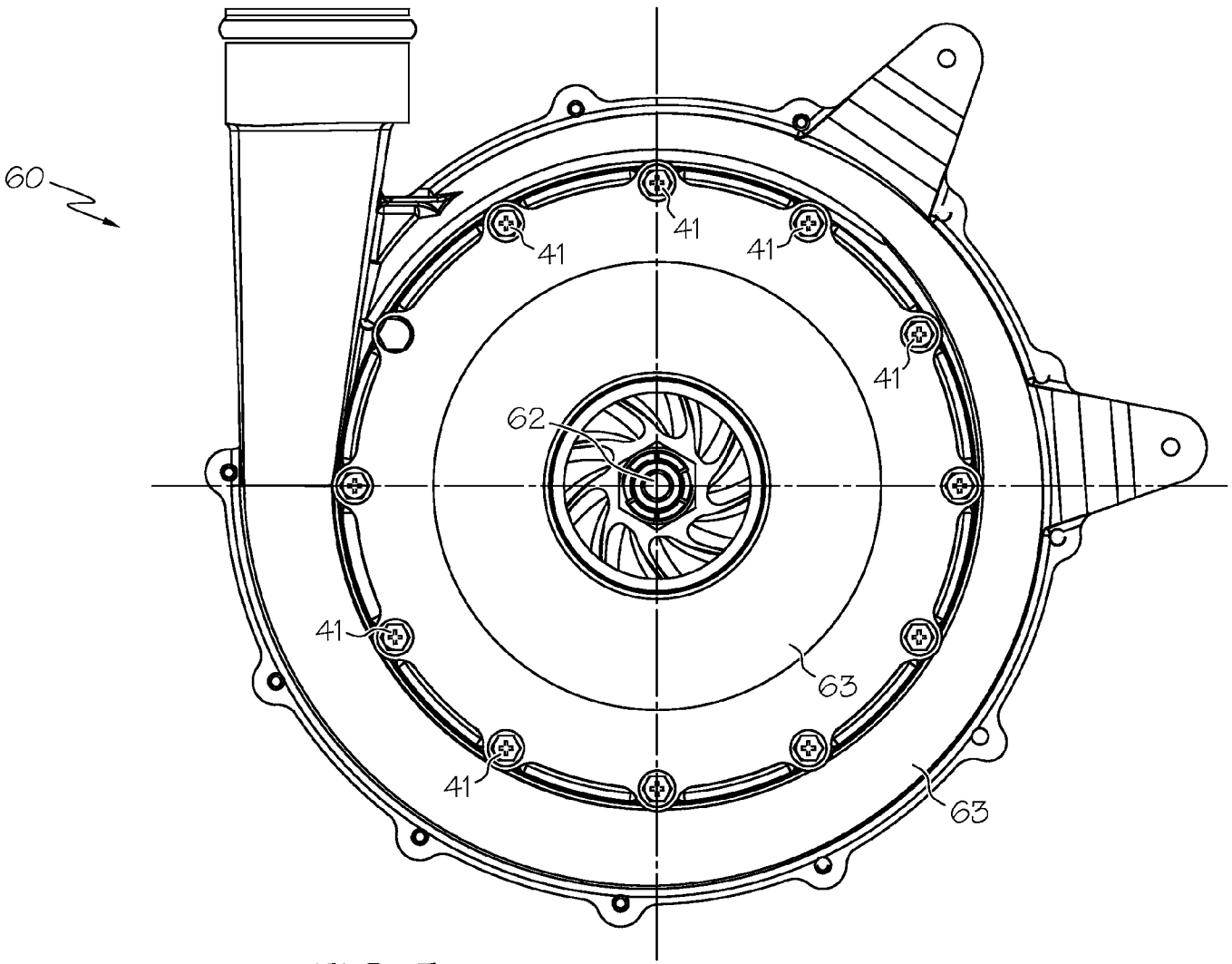
FIG. 7 is a plan view of a containment system installed on a compressor, according to an embodiment of the present invention.

The containment system 40 may comprise at least one passage obstructer 41. The number of passage obstructers 41 may vary with application and may depend on the dimensions of the impeller 61 and the requirements of the compressor 60. For some two-stage aircraft compressors, the number of passage obstructers 41 may be between about 1 and about 12. The containment system 40 may comprise a plurality of circumferentially spaced passage obstructers 41, as depicted in FIG. 7. The passage obstructers 41 may be evenly or unevenly spaced around the housing 63. The passage obstructers 41 may be positioned such that the passage obstructers 41 do not interfer with the rotation of the impeller 61.

The housing 63, as depicted in FIG. 4, may comprise one or more housing members. For example, for some two-stage compressors, the housing 63 may include the first stage inlet cover 64, the middle housing 65 and the second stage back housing 66. In this example, the scroll housing containment structure 69 may comprise a portion of the middle housing 65. For some embodiments, the scroll housing containment structure 69 may comprise other housing members or combinations of housing members. For some embodiments, the scroll housing containment structure 69 may comprise a structure that is not integral to any one of the housing members. For some two-stage compressor applications, the passage obstructer 41 may fasten the first stage inlet cover 64 to the middle housing 65 and may be in contact in with the second stage back housing 66. For some single-stage compressor applications, not depicted, the housing 63 may include the inlet cover 64 and the back housing 66, and the passage obstructer 41 may be in contact with the inlet cover 64 and the back housing 66. For some single-stage compressor applications, the scroll housing containment structure 69 may comprise a portion of the inlet cover 64. The housing 63 may define the diffuser passage 67.

The diffuser passage 67 may comprise a passage positioned between the impeller 61 and the scroll housing containment structure 69. The diffuser passage 67 may comprise a vaneless diffuser, as depicted. The vaneless diffuser may include an annular volume that circumferentially surrounds the impeller 61. The annular volume may be designed to receive the supply of compressed air from the impeller 61 and to reduce the velocity of the compressed air. For some embodiments, the diffuser passage 67 may comprise other diffuser types, such as a vaned diffuser.

Figure 10:
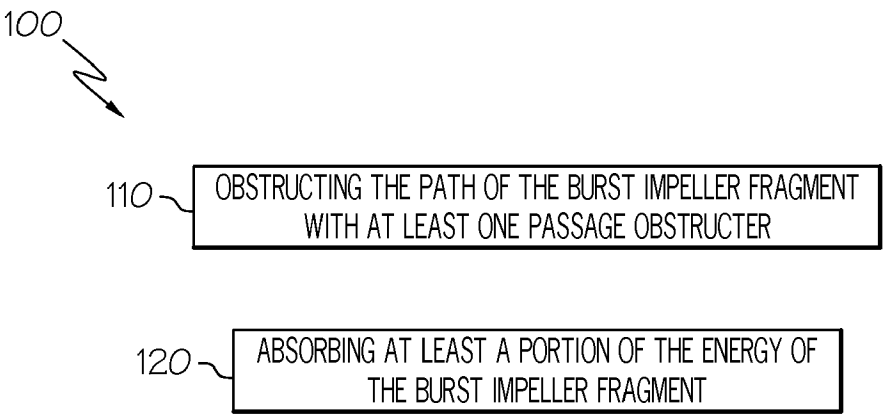
FIG. 10 is a flow chart of a method of containing a burst impeller fragment that is traveling along a path in a radially outward direction according to an embodiment of the present invention.

A method 100 of containing a burst impeller fragment that is traveling along a path in a radially outward direction is depicted in FIG. 10. The method 100 may comprise a step 110 of obstructing the path of the burst impeller fragment with at least one passage obstructer 41; and a step 120 of adsorbing at least a portion of the energy of the burst impeller fragment.

The step 110 of obstructing the path of the burst impeller fragment may comprise obstructing the path of the burst impeller fragment such that the direction of the burst impeller fragment is altered by contact with the passage obstructer 41. The step 110 of obstructing the path of the burst impeller fragment may comprise obstructing the path of the burst impeller fragment such that the radial movement of the burst impeller fragment is ceased by contact with the passage obstructer 41.

The step 120 of absorbing at least a portion of the energy of the burst impeller fragment may comprise absorbing at least a portion of the energy of the burst impeller fragment with the passage obstructer 41. The step 120 of absorbing at least a portion of the energy of the burst impeller fragment may comprise absorbing the energy of the burst impeller fragment such that the velocity of burst impeller fragment is reduced by contact with the passage obstructer 41. The step 120 of absorbing at least a portion of the energy of the burst impeller fragment may include bending an obstructing portion 43 of the passage obstructer 41 by impacting the obstructing portion 43 with the burst impeller fragment.

EXAMPLE 1

A containment system 40 according to an embodiment of the present invention was installed on a compressor 60. Nine passage obstructers 41 were used to replace existing fasteners in the compressor housing 63. Each passage obstructer 41 was positioned such that a portion of the passage obstructer 41 extended through the diffuser passage 67 of the compressor 60. The passage obstructers 41 were circumferentially spaced, as depicted in FIG. 7. (In FIG. 7, eleven passage obstructers 41 are depicted.)

A tri-hub test was performed. Generally, in practice, an impeller 61 will break from a single failure origin, often from a fault in the bore, where the stress is often maximum. The exact fracture mode is unpredictable and can result in impeller fragments of various sizes and shapes. Theoretically, the most dangerous and damaging failure configuration is a failure that produces three equal impeller fragments. For a tri-hub test, three evenly spaced slots are cut into the hub of the impeller 61 to weaken the hub to the point where it bursts at, or marginally above, the maximum operating speed of the compressor 60. The results of the tri-hub test are shown in FIGS. 8 and 9.

Figure 8:
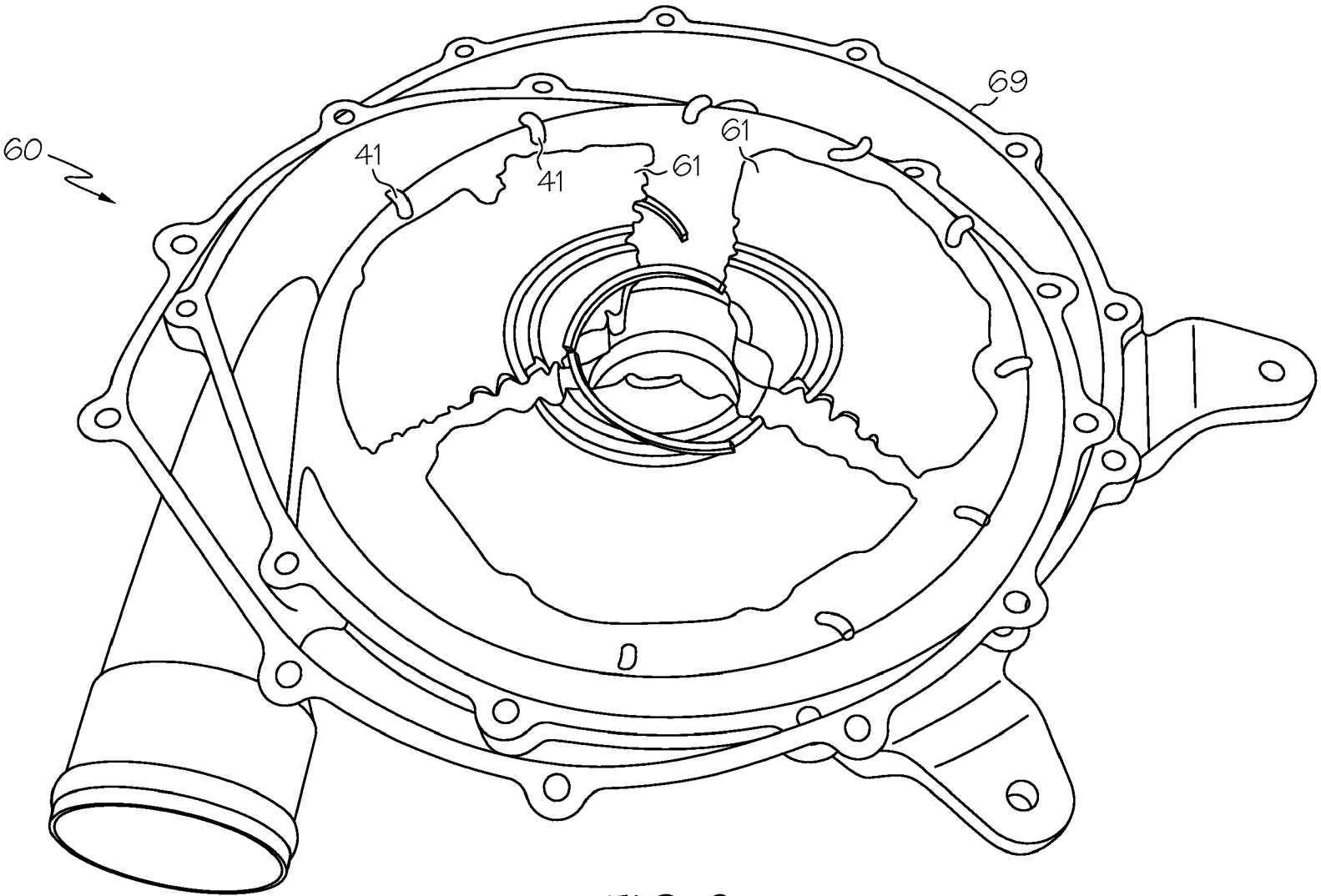
FIG. 8 is a scan of a post-test photograph of a containment system installed on a compressor with the impeller in a tri-hub burst pattern, according to an embodiment of the present invention.
Figure 9:
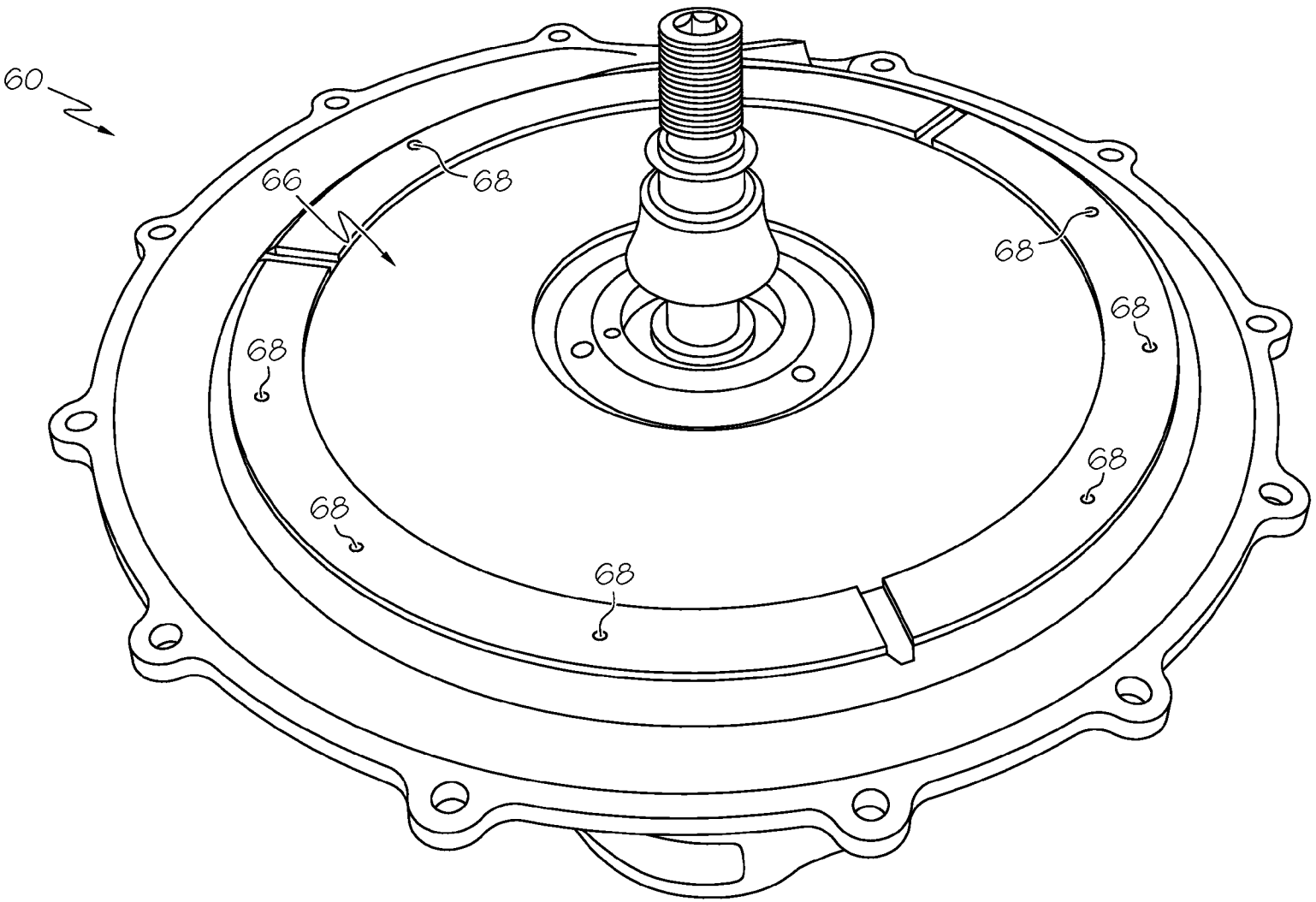
FIG. 9 is a scan of a post-test photograph of a second stage back housing, according to an embodiment of the present invention.

FIG. 8 is a scan of a post-test photograph of the containment system showing the impeller in a tri-hub burst pattern. As can be seen, the passage obstructers 41 bent and trapped the fragments of the impeller 61. The passage obstructers 41 prevented the fragments from traveling radially outward to the scroll housing containment structure 69.

As can be appreciated by those skilled in the art, the present invention provides improved containment systems. Embodiments of the present invention can provide impeller containment systems that do not adversely affect the weight and envelope of the engine. Embodiments of the present invention can provide impeller containment systems for use with vaneless diffusers.

It should be understood, of course, that the foregoing relates to exemplary embodiments of the invention and that modifications may be made without departing from the spirit and scope of the invention as set forth in the following claims.

We claim:

1. A system for an impeller comprising:

a housing surrounding said impeller;

a diffuser passage defined by said housing;

at least one passage obstructer having an obstructing portion, said obstructing portion extending through said diffuser passage; and wherein said passage obstructer includes a fastener portion having a fastener shaft, and wherein a diameter of said obstructing portion is less than a diameter of said fastener shaft.

2. The system of claim 1, wherein a length of said obstructing portion is greater than a width of said diffuser passage.

3. The system of claim 1, wherein said diffuser passage comprises a vaneless diffuser.

4. The system of claim 1, wherein said system comprises a plurality of circumferentially spaced passage obstructers.

5. The system of claim 1, wherein said passage obstructer is in contact with said housing and extends axially though said diffuser passage.

6. The system of claim 1, wherein said housing includes a recess in contact with said obstructing portion, said recess having a depth of between 0.050 and 0.100 inches.

7. The system of claim 1, wherein said passage obstructer includes a fastener portion and wherein said housing includes an inlet cover, said fastener portion extending through said inlet cover.

8. An apparatus for a compressor having a vaneless diffuser comprising:

a fastener portion;

an obstructing portion integral to said fastener portion, said obstructing portion extending axially through said vaneless diffuser;

a housing comprising a first stage inlet cover and a middle housing, wherein said fastener portion extends through said first stage inlet cover and through at least a portion of said middle housing.

9. The apparatus of claim 8, wherein said compressor comprises a two-stage compressor.

10. The apparatus of claim 8, wherein said compressor comprises a single-stage aircraft compressor.

11. The apparatus of claim 8, wherein compressor includes a back housing having a recess, said obstructing portion in contact with said recess.

12. The apparatus of claim 8, wherein a diameter of said obstructing portion is less than a diameter of said fastener portion.

13. The apparatus of claim 8, wherein a length of said obstructing portion is greater than a width of said vaneless diffuser.

14. The apparatus of claim 8:

wherein the housing further comprises a second stage back housing comprising a recess;

wherein said fastener portion fastens said first stage inlet cover to said middle housing; and wherein said obstructing portion extends into said recess.

* * * * *